United States Patent [19]

Cavigli et al.

[11] Patent Number: 4,692,929

[45] Date of Patent: Sep. 8, 1987

[54] SELF-BAKING ELECTRODE FOR ELECTRIC ARC FURNACES AND THE LIKE

[75] Inventors: Mario Cavigli, Mestre, Italy; Lorenzo Ferrari, Lugano, Switzerland

[73] Assignee: Kinglor-LTD, Lugano, Switzerland

[21] Appl. No.: 871,432

[22] PCT Filed: Sep. 30, 1985

[86] PCT No.: PCT/EP85/00504

§ 371 Date: May 19, 1986

§ 102(e) Date: May 19, 1986

[87] PCT Pub. No.: WO86/02800

PCT Pub. Date: May 9, 1986

[30] Foreign Application Priority Data

Oct. 23, 1984 [EP] European Pat. Off. ..... 84112756.6

[51] Int. Cl.[4] ..... H05B 7/09

[52] U.S. Cl. ..... 373/89

[58] Field of Search ..... 373/97, 89

[56] References Cited

FOREIGN PATENT DOCUMENTS

| | | | |
|---|---|---|---|
| 1151108 | 8/1983 | Canada | 373/89 |
| 22921 | 1/1981 | European Pat. Off. . | |
| 1161652 | 10/1959 | Fed. Rep. of Germany | 373/89 |
| 1615418 | 6/1970 | Fed. Rep. of Germany . | |
| 2521873 | 11/1976 | Fed. Rep. of Germany . | |

*Primary Examiner*—Roy N. Envall, Jr.

*Attorney, Agent, or Firm*—Collard, Roe & Galgano

[57] ABSTRACT

Self-baking electrode for electric arc furnaces, particularly suited to the production of metal silicon, ferro-alloys and the like, including a containing metal casing (1), an electrodic carbonaceous mass (4,7) and a supporting structure (8) for said electrodic mass, said supporting structure being manufactured from carbon fibres and/or composite materials based on carbon fibres, which permits to obtain products, in particular metal silicon, having a high titer and a low impurity content. Said electrode is also endowed with improved mechanical characteristics.

8 Claims, 1 Drawing Figure

SELF-BAKING ELECTRODE FOR ELECTRIC ARC FURNACES AND THE LIKE

DESCRIPTION

Figure 1:
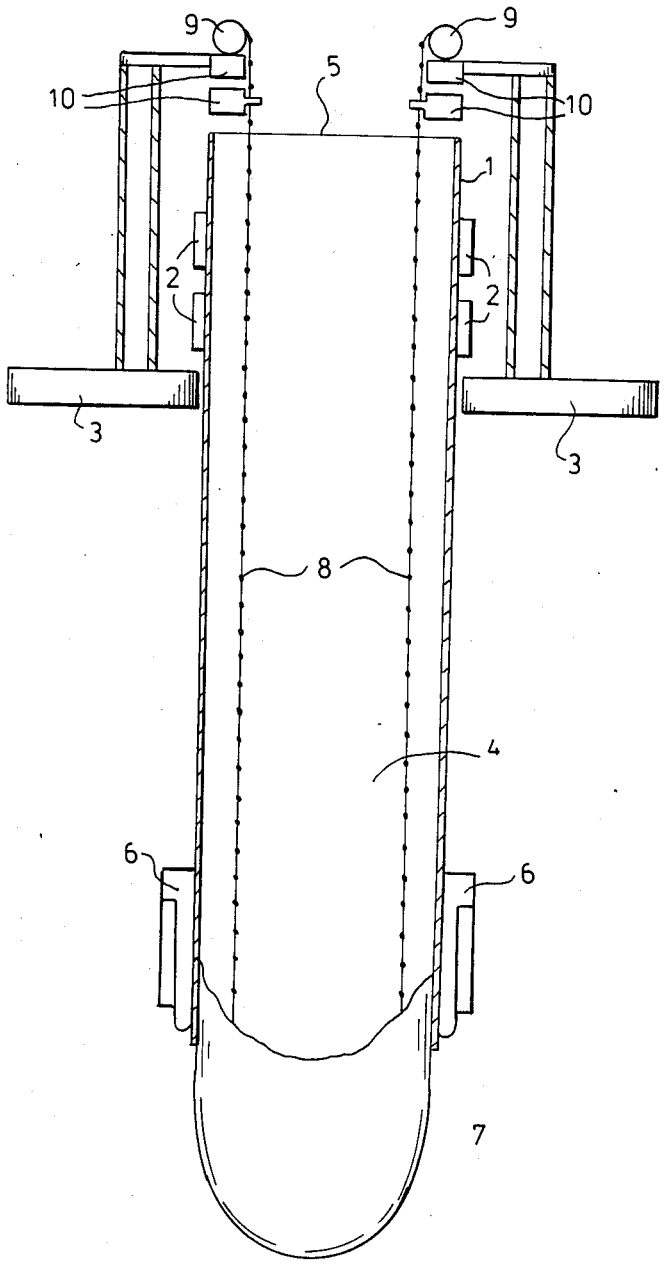

This invention relates to a self-braking electrode for electric arc furnaces and the like, particularly suited to the production of metal silicon, ferro-alloys, calcium carbide, phosphorus and the like, said electrode consisting of a cylindrical metal casing, of an electrodic mass contained and guided by said metal casing during its formation, solidification and baking steps, and of a reinforcing and sustaining structure which supports said mass, said structure being such as to allow to obtain the final products, in particular metal silicon, without any significant addition of foreign elements.

As is known, various products of the metallurgical industry, such as for example metal silicon, phosphorus, ferrochrome, ferromanganese, calcium carbide and the like, are obtained by reduction of the corresponding ores in an electric arc furnace. The electrodes for said furnaces may consist of cylindrical coal blocks of proper dimensions, which consume in consequence of oxidation and of the contact with the charge, and which, therefore, by means of suitable devices, are lowered as they get consumed and are then replaced by new electrodes when their dimensions have become, in consequence of the consumption, lesser than the minimum allowable dimensions.

Instead of being made of coal, the electrodes may consist of graphite, which is a more expensive material but exhibits a higher conductivity, a higher mechanical resistance and a higher purity, and therefore permits to obtain products of better quality because more pure.

Another type of electrode which too is utilized in the arc furnaces is the one usually referred to as self-baking electrode. Such electrode consists of a metal cylindrical casing, usually a steel casing, equipped with radial fins in its inside, into which casing the electrodic paste is introduced from the top, such paste being made of a variously ground carbonaceous material and of pitch. The electrodic paste, because of the heating due to the current flow, solidifies and bakes, thus forming an integral body with the outer metal casing to which it is anchored by means of said inner fins which have just the function of supporting the electrodic paste mass. In this case the outer metal casing and the fins consume along with the coal. By this type of electrode, which is less expensive than the one consisting of coal blocks or of graphite blocks, an economic saving is attained, but there is the serious drawback of introducing, into the furnace reaction mass, and therefore into the final product, the metal, usually iron, of which the casing and the fins are made, which, as told hereinbefore, gets consumed together with he electrodic paste during the process. Consequently, this type of electrode cannot be utilized for the production of high-quality and low-purity products (which, as is known, find broader and broader utilizations in several technological fields), such as e.g. metal silicon with a low iron content.

A progress in respect of the conventional self-baking electrode is represented by an electrode, always self-baking, in which, however, the outer metal casing is not bound to and integral with the electrodic mass by means of the fins, but is substantially fixed, while the electrodic mass flows in its inside as it is supported by a rod-shaped steel element not bound to and independent of the outer casing, as is described for example in Italian Pat. No. 606568. By means of this type of electrode it is possible to obtain products of better quality, since only the iron, of which said rod-shaped element is made, consumes along with the electrodic mass and passes into the furnace reaction mass and, consequently, into the final product.

An object of the present invention is that of providing a self-baking electrode for arc furnaces which avoids the introduction of foreign elements, in particular iron, into the furnace charge during the reaction and into the final product, and which permits to obtain products, in particular metal silicon, of high quality and with a low impurity content.

Another object of the present invention is that of providing a self-baking electrode endowed with high mechanical and thermal shock-resistance characteristics, capable of resisting even to intense mechanical and thermal stresses without the risk of cracks and/or breaks, splinters and the like, which represent always solutions of continuity of the electrode and which cause irregularities in the current distribution with consequent inconveniences in the process trend.

These and still other objects, which will be better apparent from the detailed description given hereinafter, are advantageously achieved by a self-baking electrode for electric arc furnaces and the like, particularly suited to the production of metal silicon, ferroalloys, calcium carbide, phosphorus and the like, of the type consisting of:

a cylindrical metal casing, preferably of stainless steel, for containing and guiding the electrodic carbonaceous mass, said casing being equipped with devices, of the conventional type, suitable for allowing shiftings in respect of the furnace's fixed structures;

an electrodic carbonaceous mass which can flow downwards in the containing casing inside as a function of the consumption of the electrode's lower end, which gradually forms by feeding, into the upper portion of the casing, electrodic paste, such electrodic paste being then baked in the lower portion of said containing casing because of the heating due to the passage of feeding current, thus forming the electrode's lower end on which the arc strikes;

a supporting structure suited to sustain the weight and to allow the sliding of said electrodic carbonaceous mass in the containing casing, such structure being made, according to this invention, of carbon fibres and/or of composite materials based on carbon fibres, said structure exhibiting furthermore such a configuration as to improve the mechanical resistance and the characteristics of compactedness and homogeneity of the electrodic carbonaceous mass.

The self-baking electrode forming the object of the present invention—thanks to the supporting structure of the electrodic carbonaceous mass prepared from carbon fibres with exclusion of any metal component and in particular of iron—permits to obtain products having quality and purity characteristics analogous with the ones obtainable with the electrodes (much more expensive, as is known) consisting of coal or graphite blocks.

In fact, while in the conventional self-baking electrodes the metal support of the electrodic carbonaceous mass, since it consumes together with said electrodic mass, gives rise to the passage, into the furnace's reaction mass, of the metal or metals which the support itself is made of, usually steel (such metals passing then in turn into the final product, thus polluting it), in the self-baking electrodes according to the present invention the support of the electrodic carbonaceous mass, being composed of carbon fibres, i.e. a pure material chemically homogeneous with the electrodic mass, as it consumes along with said mass, does not give rise to the passage of foreign elements into the reaction mass and, consequently, of polluting elements into the final product. For example, in the production of metal silicon by using a conventional self-baking electrode, the iron amount due to the electrode which goes into the metal silicon produced is equal to about 1 Kg/100 Kg of silicon, whereas using the electrode according to the present invention, the iron amount due to the electrode which goes into the silicon, and which in such case is due in practice only to the iron contained as an impurity in the initial electrodic paste, is equal to about 0.03 Kg/100 Kg of metal silcon produced.

The structure made of carbon fibres, prepared and dimensioned according to the present invention, has also the function of improving the mechanical, homogeneity and compactedness characteristics of the electrodic carbonaceous mass and of the under-baking and baked portion in particular. In fact, since the tensile strength of the carbon fibres varies from a minimum of 50,000 to 100,000 psi for the type having an amorphous structure, up to 350,000 psi for the type having a polycrystalline structure, the carbon fibre structure which supports the self-baking electrode and remains incorporated in said electrode and intimately bound thereto, represents a reinforcing element towards the mechanical and thermal stresses to be born by the electrode, thus substantially reducing the danger of breaks, cracks and the like, which jeopardize the continuity and stability of the electrode. Furthermore, such reinforcing element, thanks to the high resistance to high temperatures of the carbon fibre, remains unaltered and retains its effectiveness for a higher section also in proximity of the electrode lower end, which, as is known, is subjected to very high temperatures because of the arc.

The low conductivity of the carbon fibre, moreover, increases the electric resistance of the electrode and permits so to the electric current to distribute more uniformly and homogeneously in the entire electrode mass.

The carbon fibre structure supporting the electrodic carbonaceous mass can be made in different forms, provided such forms are capable of fixing in the electrode carbonaceous mass by means of links, slots, rings, knots and the like.

Said structure can be prepared, for example, according to a preferred embodiment, in the form of a continuous tubular net, substantially concentric to the outer containing casing, rolled up, on the upper part, on a proper roll device having the function both of delivering, by means of unrolling, the carbon fibre structure as the electrodic carbonaceous mass, wherein the structure is buried, comes down owing to the electrode consumption, and of supporting said electrodic carbonaceous mass by bearing the load thereof. Another embodiment of said structure may consist for example in a set of carbon fibre cables, they too wound up, in their upper part, on rolls or reels always acting as delivering and supporting devices, said cables being provided with knots, protuberances of any kind and the like, suited to represent an anchorage for the electrodic carbonaceous mass.

The carbon fibre roped elements utilized for manufacturing nets, cables and other similar supporting structures, may be also prepared by using carbon fibres of a different type, such as for example the type "Toreka" M40 manufactured by the company Tore K.K., consisting of fibres having an average diameter of 7 $\mu$m and an average length of 100 mm.

Said roped elements may be also prepared from carbon fibres of the type precoated for example with $SiO_2$ or with SiC in order to increase, as is known, their mechanical and chemical resistance characteristics. Said roped elements, in particular in all those cases where silicon does not represent a foreign element or an impurity, such as for example in the case of metal silicon, can be also prepared, according to another embodiment of the present invention, from carbon fibres either braided and/or blended with fibres based on $SiO_2$ and/or silicon carbide.

Further structural and functional properties of the electrode according to the invention are apparent from the following description in connection with the annexed drawing, which is given for merely illustrative and not limitative purposes, in which the only FIGURE schematically represents a self-baking electrode carried out according to the invention.

With reference to such FIGURE, the numeral 1 indicates the cylindrical metal casing acting as a container and as a guide, preferably made of stainless steel. Said casing can slide, whenever necessary, by means of device 2, which connect it to supporting structure 3 of the electrodic group.

Casing 1 is filled with the electrodic carbonaceous mass 4. The raw electrodic paste (consisting, as is known, of a mixture of variously ground carbonaceous substances and pitch in such proportions as to reach the desired consistency and composition in fluid substances) is fed from upper portion 5 of containing casing 1.

Electric current is fed through plates 6 to the electrode.

Because of the heat due to the passage of the current, the electrodic paste bakes, and the baked electrode 7 is obtained, on the lower end of which the arc strikes. The weight of the electrodic carbonaceous mass 4, consisting at its lower end by baked electrode 7 and in the upper layers by electrodic paste differently baked as a function of the distance from the current inlet area 6, is born, according to the present invention, by the carbon fibre supporting structure 8, which, in its lower part, is integral with electrode 7, while its upper end is wound on rolls or reels 9.

An electrode 7 consumes, unwinding device 10 for unrolling the carbon fibre structure 8 permits to cause the carbonaceous mass to flow in containing cylinder 1 and to provide the furnace with new electrode portions by feeding from 5 corresponding amounts of raw electrodic paste.

We claim:

1. A self-baking electrode for electric arc furnaces comprising a containing and guiding metal casing, an electrodic carbonaceous mass flowing in said containing casing, and a supporting structure for said electrodic mass, said supporting structure being composed of braided carbon fibres arranged in a manner so as to form a supporting element for said carbonaceous mass.

2. The self-baking electrode for electric arc furnaces according to claim 1, wherein said supporting structure is prepared from roped elements consisting of braided carbon fibres, said roped elements being arranged in the form of a net, and/or of cable provided with knots, protuberances or the like.

3. The self-baking electrode according to claim 1, wherein said carbon fibres are precoated with $SiO_2$.

4. The self-baking electrode according to claim 1, wherein said carbon fibres are precoated with SiC.

5. The self-baking electrode according to claim 2, wherein said carbon fibre roped elements are braided with roped elements consisting of $SiO_2$ fibres.

6. The self-baking electrode according to claim 2, wherein said carbon fibre roped elements are braided with roped elements consisting of SiC fibres.

7. The self-baking electrode according to claim 1, wherein said carbon fibres have an amorphous structure.

8. The self-baking electrode according to claim 1, wherein said carbon fibres have a polycrystalline structure.

* * * * *